United States Patent [19]

Swanson

[11] 4,248,693

[45] Feb. 3, 1981

[54] PROCESS FOR RECOVERING HYDROCARBONS AND OTHER VALUES FROM TAR SANDS

[76] Inventor: Rollan Swanson, 220 California Ave., Santa Monica, Calif. 95405

[21] Appl. No.: 94,685

[22] Filed: Nov. 15, 1979

[51] Int. Cl.[3] ..... C10G 1/00; C10G 1/04

[52] U.S. Cl. ..... 208/11 R; 208/11 LE

[58] Field of Search ..... 208/11 R, 11 LE

[56] References Cited

U.S. PATENT DOCUMENTS 4,003,823 1/1977 Baird et al. ..... 208/11 R

*Primary Examiner*—Herbert Levine

*Attorney, Agent, or Firm*—Albert F. Kronman

[57] ABSTRACT

Disclosed is a process for recovering hydrocarbons from tar sands by contacting the tar sands with alkali metal sulfides or alkanol solutions of alkali metal hydrosulfides, at temperatures between 40° C. and 450° C., in the presence of steam or hydrogen or mixtures thereof, thereby producing at least partially, hydrogenated hydrocarbons lower in sulfur and nitrogen content than the initial untreated hydrocarbons of the tar sands and which readily distill from the sands.

14 Claims, No Drawings

PROCESS FOR RECOVERING HYDROCARBONS AND OTHER VALUES FROM TAR SANDS

BACKGROUND OF THE INVENTION

A significant portion of the hydrocarbons, present in the crust of the earth, are found in the tar sands of the world. In order to extract the products normally obtained from petroleum crude from the tar sands, it is necessary to separate the hydrocarbons of the tar sands from the sands, to reduce the sulfur and nitrogen content of the separated hydrocarbons and to upgrade the separated hydrocarbons by increasing their hydrogen content to that of light petroleum crude.

The primary object of the process of this invention is to hydrogenate the hydrocarbons of the tar sands to allow a moderate temperature distillation of hydrocarbons from tar sands.

Another object of this invention is to reduce the sulfur and nitrogen content of hydrocarbons as they are distilled from tar sands.

A further object of the process of this invention is to achieve the above object in an economic manner.

SUMMARY OF THE INVENTION

In accordance with this invention, there is provided a process for recovering hydrocarbons and other values from tar sands comprising treating said sands with a reagent consisting essentially of an alkali metal sulfide or an alkanolic alkali metal hydrosulfide at a temperature ranging between 40° C. and 450° C. in the presence of steam, hydrogen or mixtures thereof and distilling from said sands at least partly hydrogenated hydrocarbons of reduced sulfur and nitrogen content, hydrogen sulfide and nitrogen forms and leaving behind substantially decolorized sand and a corresponding alkali metal sulfide of higher sulfur content. Thus, the primary object of the process of this invention is achieved by contacting the tar sands with solid or liquid forms of alkali metal sulfides in the presence of steam, at temperatures between 40° C. and 450° C., thereby at least partly hydrogenating the hydrocarbons of the tar sands and causing them to be distilled from the tar sands.

The other object of the process of this invention is achieved during the accomplishment of the primary object, whereby sulfur is removed from these hydrocarbons to form alkali metal polysulfides by reaction with the alkali metal sulfide constituting the reagent. More sulfur is removed as hydrogen sulfide and additional sulfur is removed as low boiling point hydrocarbons. Nitrogen is also removed during this process, mostly as ammonia.

The use of steam instead of elemental hydrogen along with the moderate temperatures employed and the combination of the de-nitrogenation and the de-sulfuring with the hydrogenation and distillation occurring in a single step renders the invention economically advantageous.

No polluting settling ponds are necessary for this process and it can possibly be carried out "in situ".

DISCLOSURE

The alkali metal sulfides and hydrosulfides are the reagents of this invention. Potassium sulfide or potassium hydrosulfide are the preferred reagents. These alkali metal sulfides or hydrosulfides may be used in solid state or in non-hydrolyzed liquid states. The alkali metal hydrosulfides are used in alkanol solutions.

The alkali metal sulfides may be prepared by passing hydrogen sulfide thru solutions of the alkali metal hydroxide in methanol, ethanol, 1-propanol or 1-butanol. The concentration of the alkali metal hydroxide should approach saturation solubilities of the particular alkali metal hydroxide in the particular alkanol. As the alkali metal hydroxide is reacted with the hydrogen sulfide, the alkali metal hydrosulfide is produced. The alkali metal hydrosulfide will react with as yet unreacted alkali metal hydroxide to form soluble alkali metal sulfide which is much less soluble in alkanol. The alkali metal sulfide will form a precipitate, usable as the reagent of this invention.

The alkali metal sulfide is more soluble in methanol than in the other alkanols and the yield of the sulfide is thereby diminished, unless the methanol is distilled from the alkali metal sulfide.

Sodium sulfide and sodium hydrosulfide are available commercially and need not be constituted as the reagent of this invention. Potassium sulfide is not available commercially and must be prepared.

Potassium hydrosulfide may be prepared by conversion of hydrolyzed potassium sulfide to potassium hydrosulfide by additional hydrogen sulfide. However potassium hydrosulfide is not stable in cold or hot water and the amount of water present to hydrolyze the potassium sulfide, as it is formed, is critical. The total water content of the alkanol, the potassium hydroxide and the water formed in the formation of potassium hydrosulfide along with added water should approximate an empirical potassium hydrosulfide dihydrate. A ratio of two moles of water to each mole of potassium hydrosulfide, will produce a relatively stable reagent.

The alkali metal sulfide or hydrosulfide reagent may be dried to a solid prior to its use in the practice of this invention. The alkanolic solution of the alkali metal hydrosulfide may be used and the alkanol distilled, along with certain hydrocarbons, at low temperature after mixing with the tar sands. The alkali metal hydrosulfide will be largely decomposed to alkali metal sulfide during the removal of the alkanol and water by distillation.

The alkanol will have been largely distilled by heating to 135° C. when the methanol or ethanol is used as the solvent for the alkali metal hydrosulfide.

At 150° C. and continuing to 162° C., the hydrate of potassium sulfide will be decomposed to a lower hydrate and water. Considerable bubbling and volume expansion are observed between 150° C. and 162° C. when potassium sulfide is used as the reagent. A similar reaction occurs at 170°-175° C.

When the alkanolic solution of the alkali metal hydrosulfide is used as the reagent, steam is not introduced into the process system until the alkanol has been distilled. The steam should not be introduced, in any case, below 135° C. This is to ensure the integrity of the alkali metal sulfide or hydrosulfide reagent. The water content of the tar sands is adequate to accomplish the mild hydrogenation which occurs below 190° C. Above 190° C., the steam must be used.

The quantity of reagent used is relative to the sulfur content of the tar sands being processed as analyzed. Potassium sulfide has a greater ability to desulfurize and to hold the sulfur obtained from the hydrocarbons of the tar sands than does sodium sulfide. Potassium sulfide can aquire sulfur from the hydrocarbons of the tar sands to form potassium trisulfide, however, in practice, the formation of $K_2S_{2.5}$ (empirical) can serve as the limit. On molal stoichiometry, at least one mole of alkali metal sulfide or hydrosulfide should be used for two moles of elemental or organic sulfur present in the tar sands.

When the alkanolic solution of potassium hydrosulfide is used as the reagent of this invention, the potassium hydrosulfide is converted largely to potassium sulfide in the presence of the tar sands and forms a solid beneath the tar sands. As the temperature is elevated, the hydrocarbons of the tar sands both melt and are dissolved by hydrocarbon gases emitting from the process system. These hydrocarbons work their way downward and react with the solid reagent, in the presence of the steam, to form additional distillate.

The steam is introduced at the bottom of the process system. In the practice of my invention, I use an elongated tubular, vertical contacting zone such as a glass tube.

The solid reagent of the alkanolic solution of the reagent is put into the bottom of a 500 cc tube. The steam line is $\frac{3}{8}''$ from the bottom of said tube so as to inject steam into the reagent. The steam line is connected to a steam generator and the connecting line between the steam generator and the tube is heated with a heating tape controlled by a powerstat. Externally supplied nitrogen is used to agitate the system when the alkanolic solution of the reagent is used and the nitrogen is used to flush the steam line clear when solid reagent is used. The tar sands are placed in the tube above the reagent. The tube is fitted with a thermometer and an outlet for the gaseous material. The outlet connects to a vertical water-cooled condenser which empties into a first condensation zone such as a flask fitted with a stopcock at its bottom. The condensation flask is heated to 100° C. to dehydrate the initial distillate condensate and to form a second distillate. The water and hydrocarbons which distill from the condensation flask is passed thru another water-cooled condenser and then collected in another condensation zone or flask. The remaining volatiles then pass thru an empty safety flask into a solution of alkali metal hydroxide. This solution of alkali metal hydroxide contains sufficient water to form a saturated aqueous solution of the alkali metal hydroxide and 2.3 times the weight of the water used to make the aqueous solution of the alkanol used to prepare the reagent. The gases next pass to a vessel for a water wash of the gas and thence to a gas test meter, which records cumulative gas flow. The gases then are vented into a hood. A chromatography tube is inserted in the line between the hood and the gas test meter. Another gas test meter is used on the line containing the nitrogen introduced into the process-system. This test meter is between the nitrogen tank and the steam generator.

As the temperature is elevated, a distillate is observed at 40° C. A part of this distillate consisted of hydrocarbons and the remainder is the alkanol and hydrogen sulfide. The hydrogen sulfide is taken up in the wash system in the water-alkanol solution of the corresponding alkali metal hydroxide. Eliminating the water from this wash, allows the reagent to be reconstituted by the hydrogen sulfide emitted by the system.

Following the distillation of the alkanol of the reagent and the reduction of the water content of the tar sands being treated, at temperatures between 135° C. and 220° C., steam is introduced into the process-system. The temperature of the steam, measured outside the system, preferably is 140° C. Generally, steam is introduced when the tar sands-alkali metal system is hot enough to vaporize all the water present.

Small amounts of hydrocarbon distillate are produced until the temperature reaches 320° C. Substantial distillate is produced to 350° C. Most of the distillate comes off at temperatures above 380° C. up to 450° C.

The initial condensate of the distillate has the hydrogen content and the viscosity of a number 2 fuel oil and the second condensate has a caloric value of above 19,000 BTU/lb with a hydrogen content ±0.25%.

The sulfur content of the second distillate is 0.2% to 0.6% while the sulfur content of the first distillate is approximately one-half that of the untreated hydrocarbons of the tar sands.

The nitrogen content of the second distillate is between 0.07% and less than 0.05%. The nitrogen content of the first distillate is between 0.1% and 0.2%.

The gases emitted from the system and passing into the wash system are largely ethene above 360° C., according to chromatographic analysis.

The residual sand is white, visually free of hydrocarbon and therefor, usable for normal purposes.

The amount of water used to generate the steam is approximately 140% of that required to furnish one hydrogen→$C_2$ of the hydrogens of water to the hydrocarbon during the hydrogenation of tar sands.

The invention is further illustrated in non-limiting fashion by the following examples:

EXAMPLE 1

Four hundred and fifty grams of an Athabasca Tar Sand containing 12% bitumen and 4% sulfur was treated with 80 ml of a methanol solution of potassium hydrosulfide containing 0.32 grams of potassium hydrosulfide per milliliter of solution. The mixture was agitated by the passage of nitrogen thru the mixture. The temperature was elevated to 170° C. A distillate was produced which distillate contained hydrocarbons dissolved in the distilled methanol and a few drops of clear hydrocarbon which floated on the surface of the distilled methanol.

At 170° C., steam was introduced into the system along with the nitrogen. The distillate which had condensed in the condensation flask was removed to prevent the further dissolving of hydrocarbon by the methanol.

An intermittant production of hydrocarbon distillate and condensate occured as the temperature was progressively elevated. Between 320° C. and 345° C., 20 ml of very light almost clear distillate was condensed. Another 25 ml of distillate condensate was produced at temperatures between 360° C. to 400° C. This distillate was yellowish as produced but was a clear reddish-brown when freed of water by centrifuging. This final condensate contained the solids which condensed in the water cooled condenser but which melted and ran down into the condensation flask when the water to the water cooled condenser was disconnected. The gases passing the wash of methanolic potassium hydroxide and water were 87% ethene after temperatures above 360° C. were reached.

The lower temperature distillate had a caloric value of 19,400 BTU/lb and a hydrogen content of 12.99%. The nitrogen content was 0.07% and the sulfur content had been reduced to 0.4%. The ash content was 0.07%. This distillate will separate by rising to the top of a settling tank.

The higher temperature distilled had a caloric value of 18,700 BTU/lb and a hydrogen content of 12.64%. The nitrogen content was 0.12% and the sulfur content was 1.7%.

Seventy-three milliliters of water had produced the steam which passed thru the system.

Several drops of very light liquid hydrocarbon had formed in the methanolic potassium hydroxide wash of the gas stream.

No potassium carbonate had been precipitated in the methanol-potassium hydroxide wash of the gas stream.

The tar sands had been cleaned of hydrocarbon and were almost white.

EXAMPLE 11

Two hundred and fifty grams of an Athabasca Tar Sand containing 12% hydrocarbon and 4.2% sulfur was treated with 80 ml of an ethanol solution of potassium hydrosulfide containing 0.24 grams of potassium hydrosulfide per milliliter of solution.

The tar sands and the reagent were placed in a reaction vessel and agitated with nitrogen as the temperature was elevated to 190° C. The distillate produced contained some hydrocarbon as proved when water was added to the distillate and a hydrocarbon cloud was formed in the mix. This initial distillate was separated at 190° C. and removed from the system.

Steam was then introduced into the system along with the nitrogen, as the temperature was elevated to 390° C.

The total water used to produce the steam was 100 ml.

The hydrocarbon distillate was separated from the system and centrifuged to remove water.

The hydrocarbon distillate contained 1.95% sulfur, 0.11% nitrogen and had a caloric value of 18,990 BTU/lb with a hydrogen content of 12.89%.

No carbon dioxide had been formed as shown by the lack of a precipitate in the methanolic-potassium hydroxide solution used to wash the uncondensed gas stream.

The sands had been reduced to white sand with no visible hydrocarbon present.

Hydrogen may be introduced in varying amounts along with the steam or prior to the introduction of the steam. Other modes of applying the principle of the invention may be employed. Surprisingly, a substantial amount of hydrocarbon cracking takes place under the process conditions, with the alkali metal sulfide possibly acting as a catalyst therefor.

What is claimed is:

1. A process for recovering hydrocarbons and other values from tar sands comprising treating said sands with a reagent consisting essentially of an alkali metal sulfide or an alkanolic alkali metal hydrosulfide at a temperature ranging between 40° C. and 450° C. in the presence of steam, hydrogen or mixtures thereof and distillng from said sands at least partly hydrogenated hydrocarbons of reduced sulfur and nitrogen contents, hydrogen sulfide and nitrogen forms and leaving behind substantially decolorized sand and a corresponding alkali metal sulfide of higher sulfur content.

2. The process of claim 1, wherein the alkali metal sulfide is sodium, potassium, rubidium sulfide, or polysulfide.

3. The process of claim 1, wherein the alkali metal sulfide is sodium, potassium or rubidium hydrosulfide.

4. The process of claim 3, wherein the sodium, potassium or rubidium hydrosulfide is in a lower alkanol solution.

5. The process of claim 1, wherein the alkali metal sulfide or hydrosulfide is present in a stoichiometry of at least one mole of alkali metal sulfide or hydrosulfide for each two moles of sulfur present in the tar sands.

6. The process of claim 1, wherein said steam is introduced into the tar sands-alkali metal sulfide when the tar sands are at a temperature adequate to maintain all the water in the system in the gaseous state.

7. The process of claim 1, wherein hydrogen is introduced into the tar sands-alkali metal sulfide prior to the introduction of said steam or along with said steam.

8. The process of claim 1, comprising agitating said tar sands and reagent with externally supplied nitrogen.

9. The process of claim 1, wherein steam is introduced at a temperature above 135° C.

10. The process of claim 1, wherein said nitrogen is in the form of ammonia.

11. The process of claim 1, comprising heating said tar sands and an alkanolic alkali metal hydrosulfide to about 135°–220° C. and removing a first hydrocarbon-containing distillate and distilled alkanol then contacting said sands and reagent with steam, heating to about 390° C. to produce a second distillate and separating said second distillate to separate hydrocarbons from water.

12. The process of claim 1 comprising collecting by heating at from 40° C. to 450° C. a condensed and uncondensed distillate containing an alkanol, hydrocarbons and hydrogen sulfide, washing uncondensed distillate with an aqueous alkanol solution of the corresponding alkali metal hydroxide and thereby reconstituting said reagent for reuse in said process.

13. The process of claim 1 comprising collecting the distillate maintaining the distillate at a temperature above 100° C. to produce a second distillate of lighter hydrocarbons and water.

14. The process of claim 1 comprising intermixing said reagent with said sands and injecting said steam into said reagent.

* * * * *